US005313918A

United States Patent [19]

Agren

[11] Patent Number: 5,313,918

[45] Date of Patent: May 24, 1994

[54] FLYWHEEL MAGNETO ARRANGEMENT

[75] Inventor: Anders Agren, Åmål, Sweden

[73] Assignee: SEM AB, Amal, Sweden

[21] Appl. No.: 838,405

[22] PCT Filed: Sep. 3, 1990

[86] PCT No.: PCT/SE90/00561

§ 371 Date: Mar. 2, 1992

§ 102(e) Date: Mar. 2, 1992

[87] PCT Pub. No.: WO91/03644

PCT Pub. Date: Mar. 21, 1991

[30] Foreign Application Priority Data

Sep. 11, 1989 [SE] Sweden ..... 8902977

[51] Int. Cl.[5] ..... F02P 1/00

[52] U.S. Cl. ..... 123/149 D

[58] Field of Search ..... 123/149 D, 601, 149 C, 123/149 A, 149 R, 599; 310/70 R, 156, 153, 152, 154

[56] References Cited

U.S. PATENT DOCUMENTS

| | | | |
|---|---|---|---|
| 3,828,754 | 8/1974 | Carlsson | 123/149 D |
| 3,893,439 | 7/1975 | Chudoba | 123/149 D |
| 3,942,501 | 3/1976 | Byles | 123/149 D |
| 4,019,485 | 4/1977 | Carlsson | 123/149 D |
| 4,345,533 | 8/1982 | Magrane et al. | 123/149 C |
| 4,628,891 | 12/1986 | Asai et al. | 123/599 |
| 4,901,704 | 2/1990 | Safranek | 123/599 |
| 4,915,068 | 4/1990 | Tharman | 123/149 R |
| 5,072,714 | 12/1991 | Bengtsson et al. | 123/601 |

*Primary Examiner*—Raymond A. Nelli
*Attorney, Agent, or Firm*--Collard & Roe

[57] ABSTRACT

The invention has for its object to solve the problem associated with the use of a flywheel magneto for supplying ignition power to multiple cylinder combustion engines. The flywheel magneto according to the invention is composed of a flywheel (1) supporting magnets arranged in groups (2, 3, 4, 5-6, 7, 8, 9). The magneto flywheel (1) coacts with a multi-leg (11-20) core (10) of magnetically conducting material, the spacing or pitch of the core legs being such that the number of legs form an integer whereas half this number has to form an odd number. Within each group the magnets (2-9) are spaced in agreement with said core pitch. Said groups (2, 3, 4, 5-6, 7, 8, 9) are separated two pitches. Two adjacent core legs (11, 12) are provided with like windings (21, 22) the outputs ends (23, 24, 25) of the windings being connected to a discriminator circuit which distributes, in dependence of series of voltage polarities, trigger pulses (37, (37, 38) to ignition circuits (39, 40) for the respective engine cylinder (41, 42). The remaining core legs can accommodate, for example, generator windings (26).

5 Claims, 6 Drawing Sheets

FLYWHEEL MAGNETO ARRANGEMENT

TECHNICAL FIELD AND PRIOR ART

In multiple cylinder combustion engines it is common practice to use, for distributing sparks to the various sparkplugs, a so called distributor, i.e. an arm synchronously coupled to the engine and having a contact function. In e.g. small two cylinder engines it could be structurally complicated as well as expensive to provide, in association with the flywheel magneto often used in such types of engines, also a distributor. There are possibilities nowadays to conduct the igniting processes by means of electronic control circuits so that igniting occurs at the proper time in the proper cylinder. However, also such solutions are comparatively expensive.

SUMMARY OF THE INVENTION

The present invention relates to a solution of the problem mentioned above. The invention is based on a process of generating a trigger releasing pulse by using asymmetric magnetic field induction. The invention thus relates to an arrangement in flywheel magnetos for multiple cylinder combustion engines, said arrangement including a magnet core, which is divided into several like parts and carries windings, and magnet poles moveable in relation to the magnet core. The novelty of the invention resides essentially in the feature that the number of core parts or divisions forms an integer and that half the number of parts forms an odd number. Moreover, the magnet poles are arranged in groups with their polarity alternating, the pole pitch within the groups coinciding with the core pitch. Adjacent core parts, thus spaced one pitch, carry each its control winding connected to a circuit for sensing voltage polarity in order to produce distributed trigger signals for the respective engine cylinder.

The features characterizing the invention will appear from the accompanying claims.

DESCRIPTION OF THE FIGURES

The invention will be described in greater detail with reference to the accompanying drawings which illustrate embodiments of the invention.

DESCRIPTION OF AN EMBODIMENT

Figure 1:
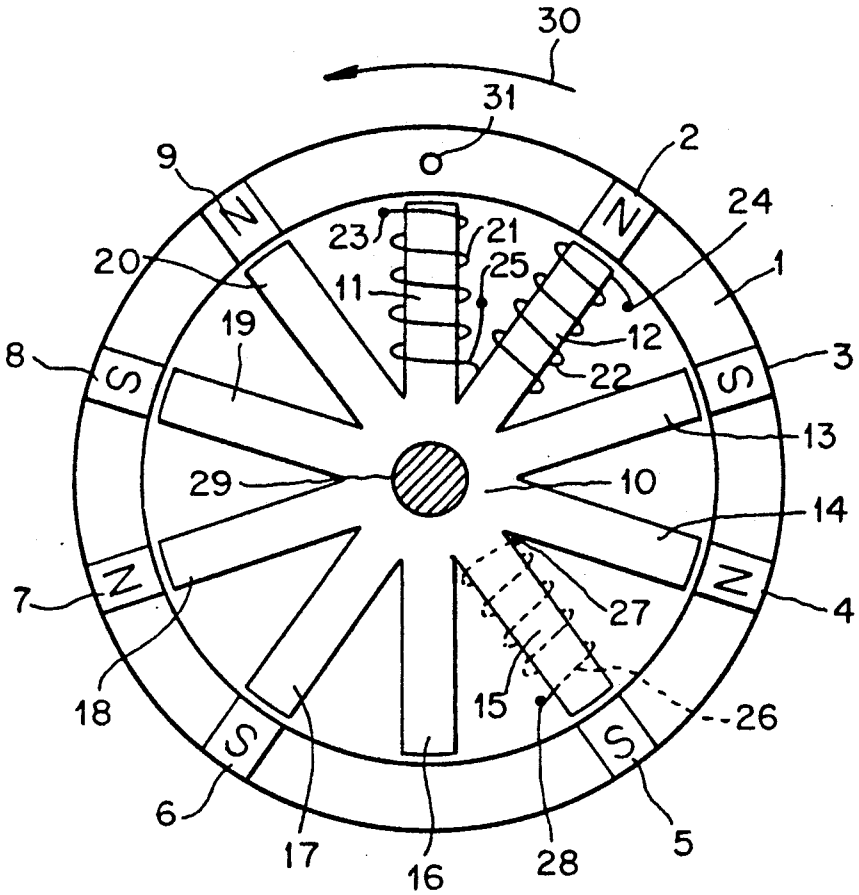
FIG. 1 shows diagrammatically the structure of a generator part of an arrangement according to the invention.

The generator part shown in FIG. 1 of the flywheel magneto comprises a flywheel 1 with eight permanent magnets forming poles 2–9 having different polarities indicated by N and S, that is, north and south. Said poles are so distributed that they are able to cooperate symmetrically with a core 10 having radially extending core legs 11–20. As can be seen the spacing or pitching is such that the number of core legs forms an even number, in this case ten, which divided into halves gives five, i.e. an odd number. As shown in the figure the magnet poles 2, 3, 4 and 5 form a group, in the illustrated case cooperating with the core legs 12, 13, 14 and 15. Poles 6, 7, 8 and 9 form a second group cooperating with core legs 17, 18, 19 and 20. Hence, with respect to spacing there is a gap between poles 2 and 9 and between poles 5 and 6.

The core leg 11 carries a trigger winding 21 and the core leg 12 carries a trigger winding 22, the windings being connected such in the present case that they are in opposition with respect to induction. The trigger winding 21 has a tapping point 23 and the trigger winding 22 has a tapping point 24. Between the two windings there is a tapping point 25. As indicated by dashed lines there is on core leg 15 a generator winding 26 for generating a charging voltage for the associated capacitor ignition system. As a matter of course winding 26 can be interconnected with other windings on legs 13–20 for generating the necessary voltage, but this is of secondary importance when it comes to explaining the present invention. Said last mentioned winding 26 has two tapping points 27 and 28.

The flywheel is assumed to rotate about a central axis 29 in a direction of rotation indicated by the arrow 30. In order to explain in the following the various processes of induction, in particular in connection with FIG. 3, an indication 31 of rotation has been made on flywheel 1, said indication being located opposite the core leg 16 in FIG. 1.

Figure 2:
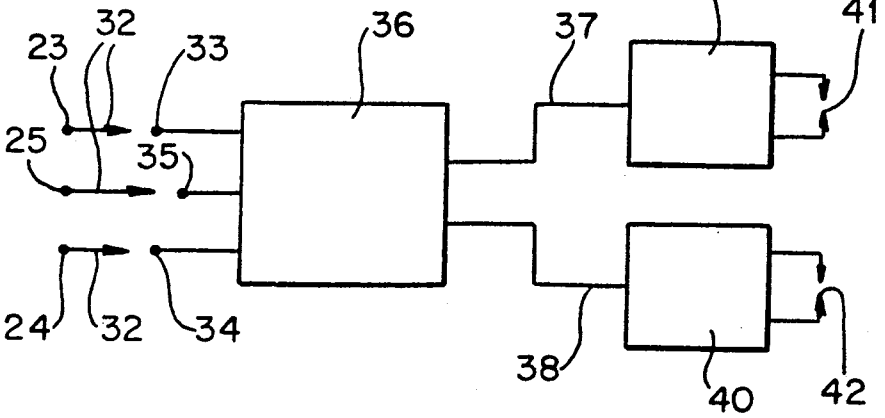
FIG. 2 shows a circuit diagram for the ignition circuits of the cylinders in an associated combustion engine.

In FIG. 2 the tapping points 23, 24 and 25 of windings 21 and 22 are shown connectable, as indicated by associated arrows 32, to inputs 33, 34 and 35 of a discriminator circuit 36. Said circuit has two outputs 37, 38 for control pulses to the respective trigger input of two ignition circuits 39, 40. A sparkplug 41, 42 is connected to the high voltage end of the respective ignition circuit. Before said last mentioned circuits according to FIG. 2 are described in greater detail reference is made to FIG. 3 with subfigures a–j.

Figure 3B:
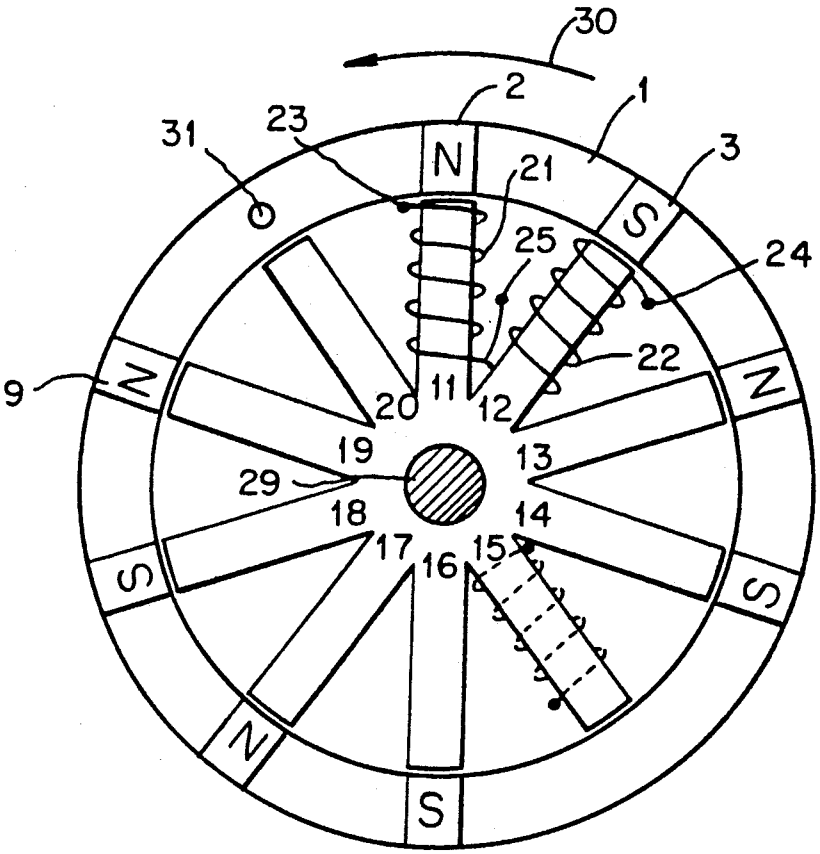
FIG. 3 is divided into ten subfigures a–j which illustrate diagrammatically various conditions of induction during one revolution of the magneto flywheel.
Figure 3A:
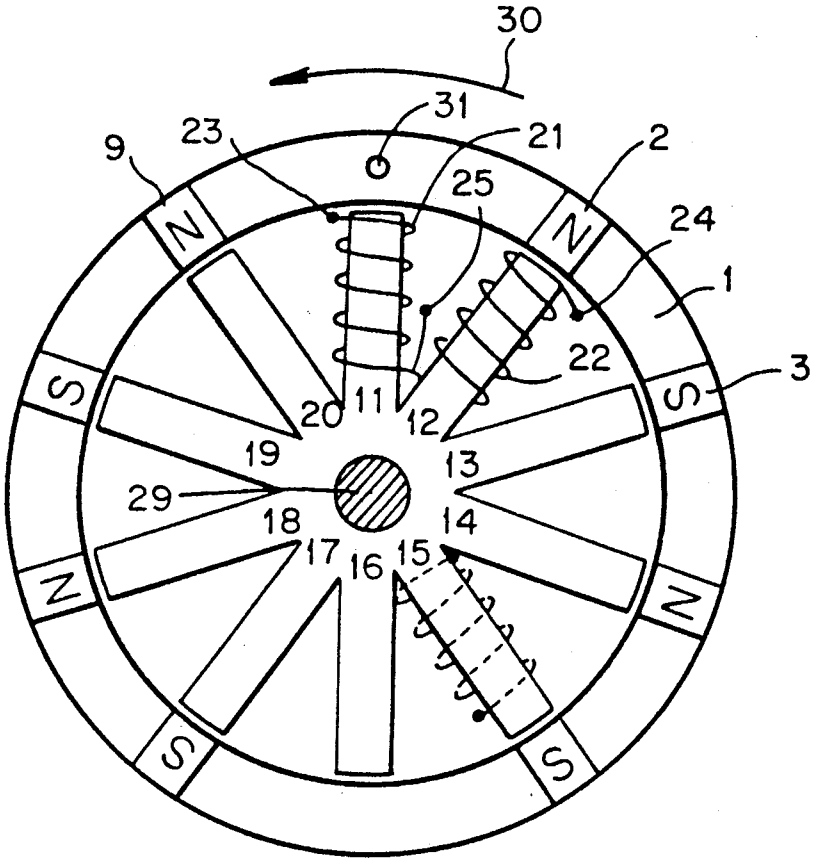
Figure 3D:
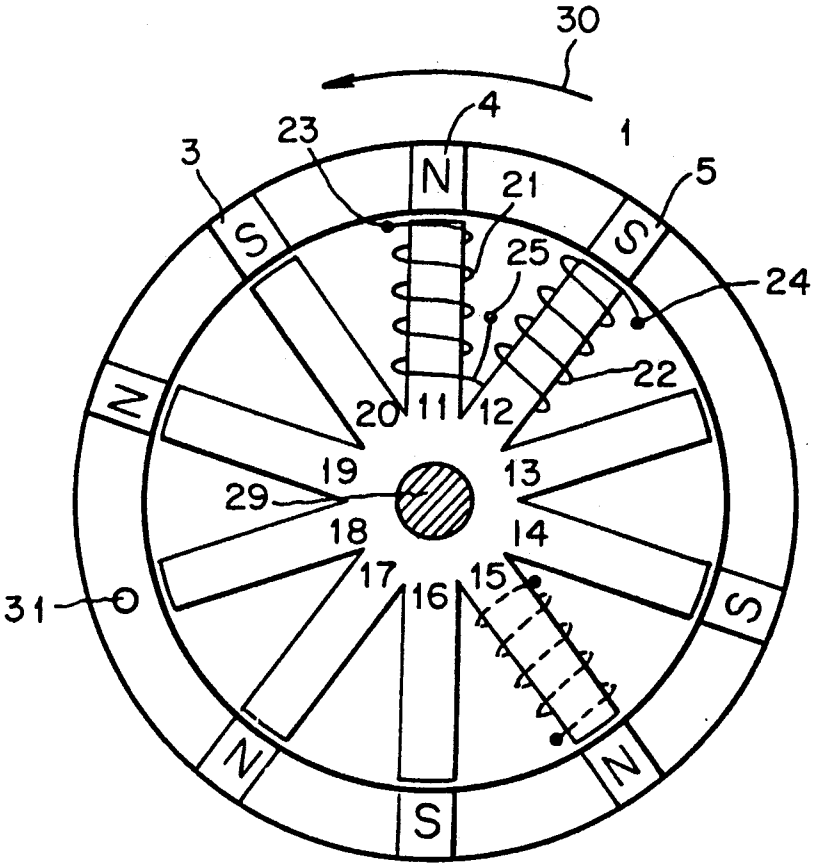
Figure 3C:
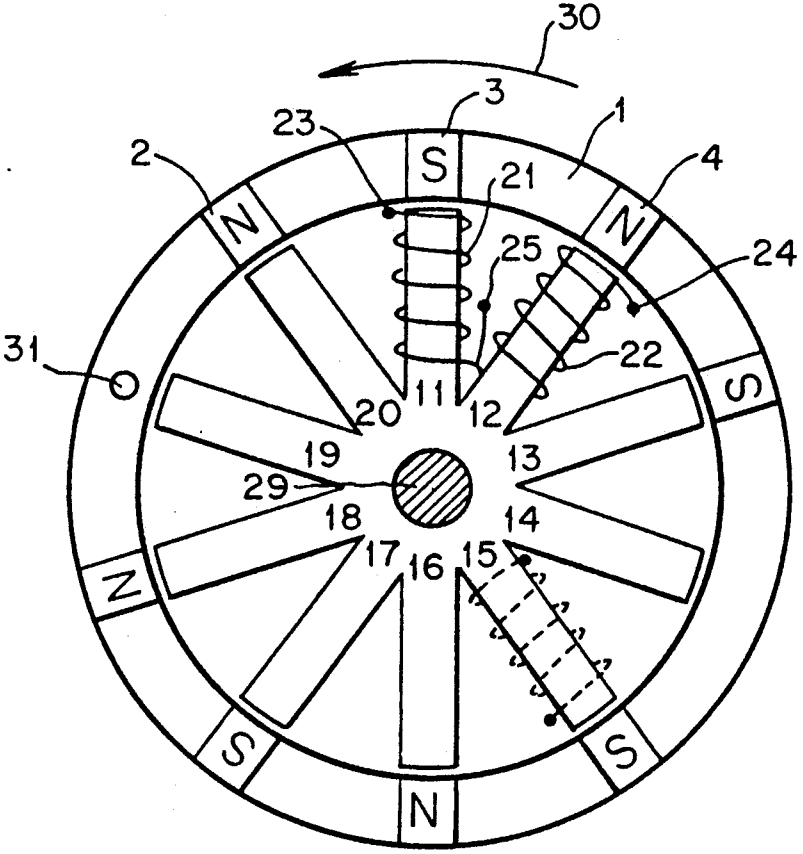
Figure 3F:
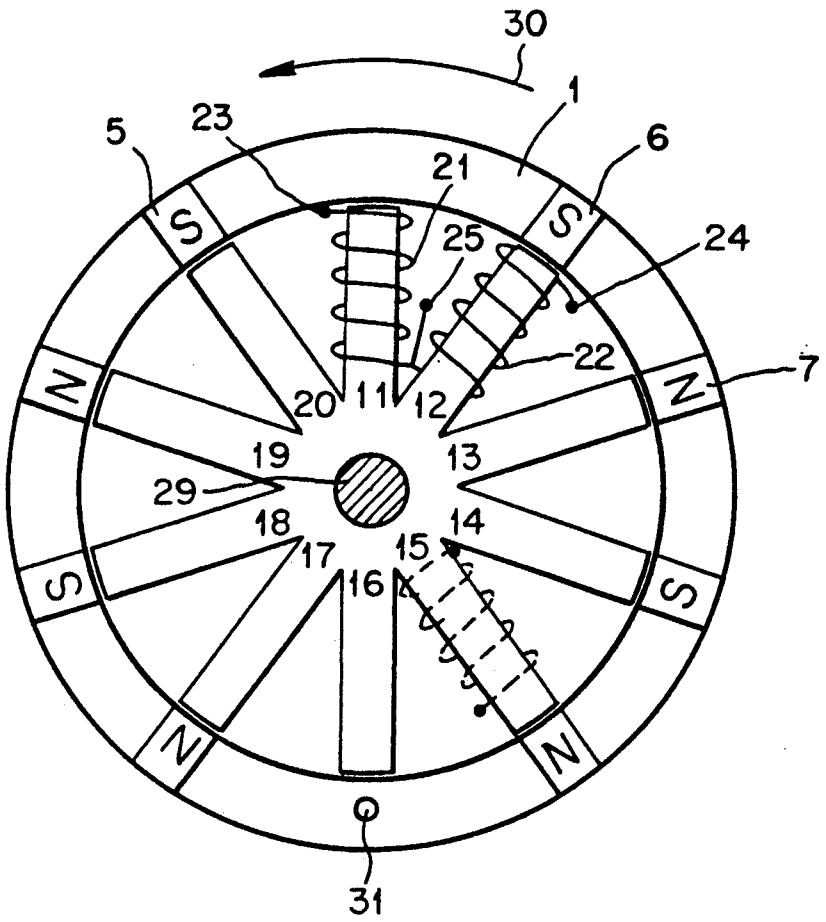
Figure 3E:
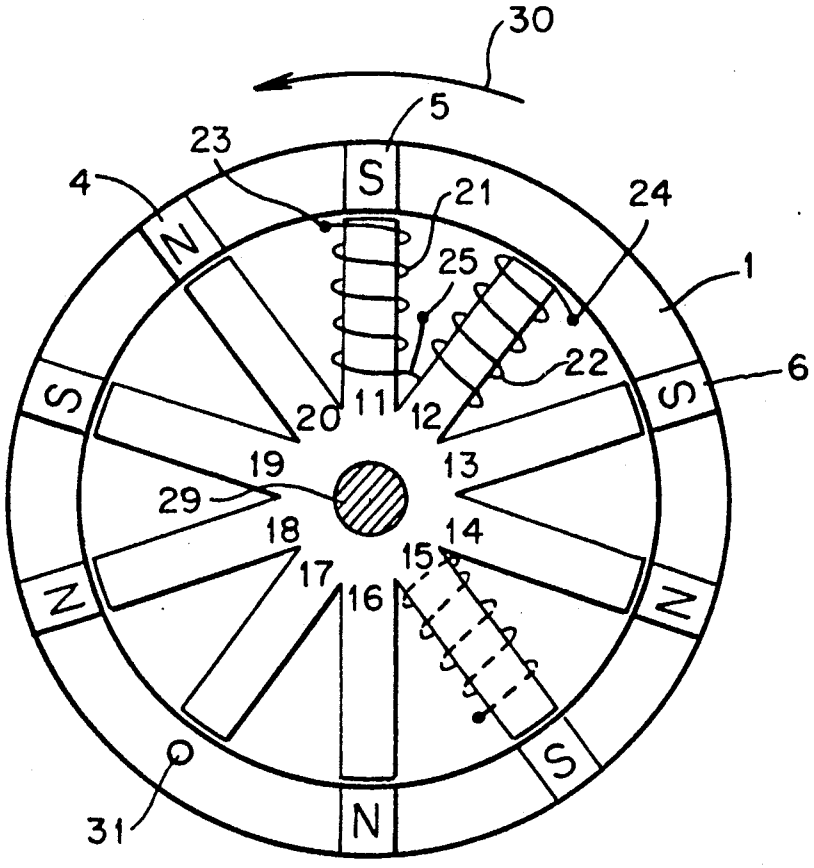
Figure 3H:
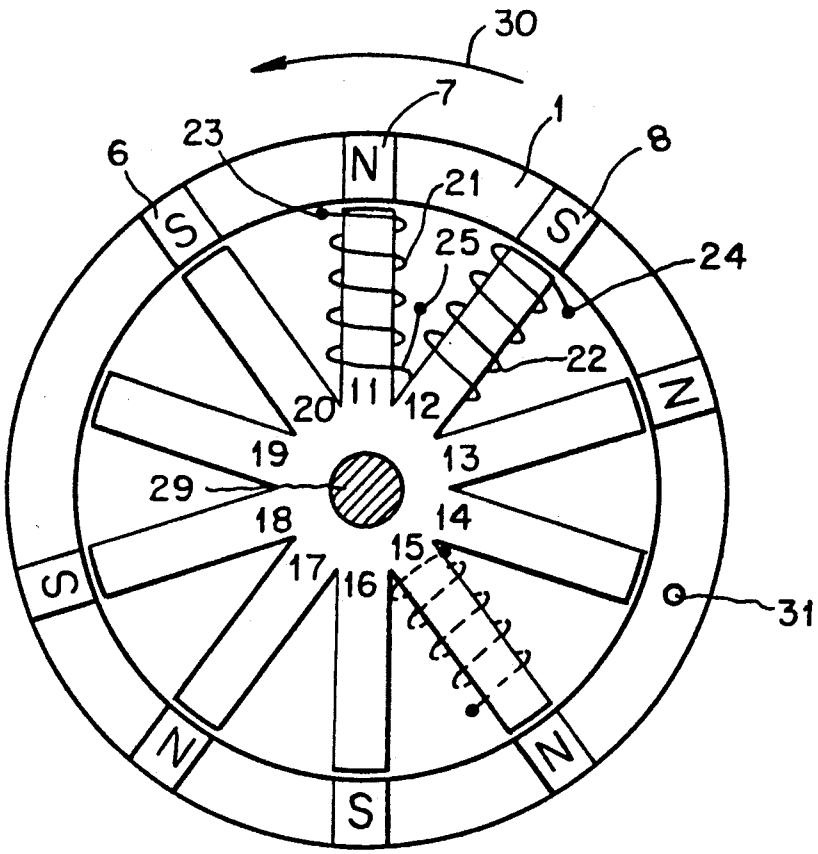
Figure 3G:
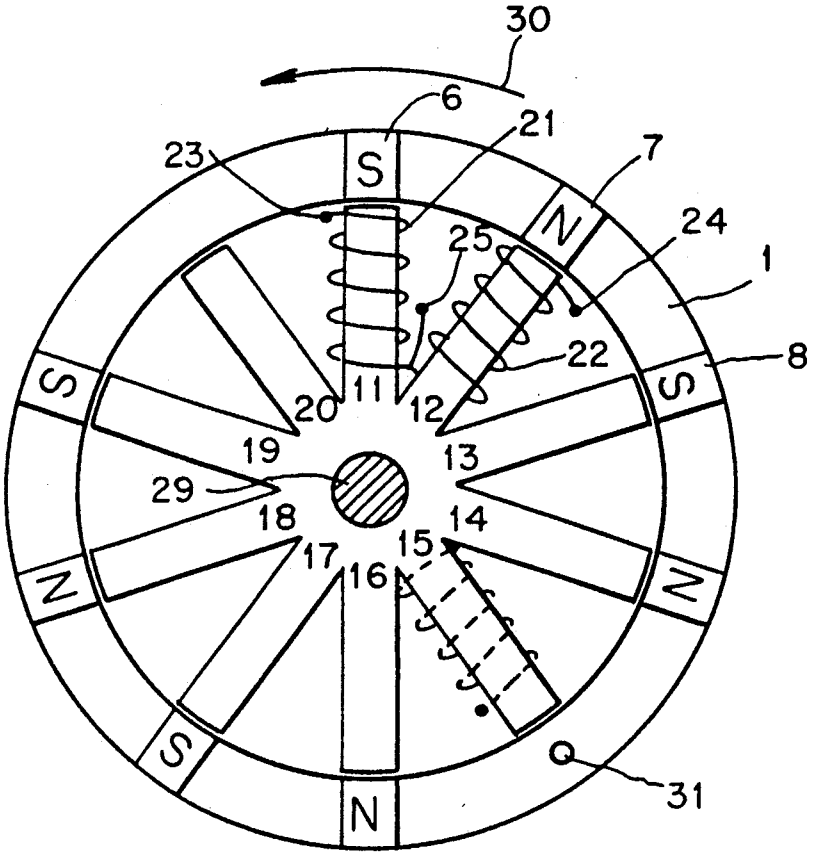
Figure 3J:
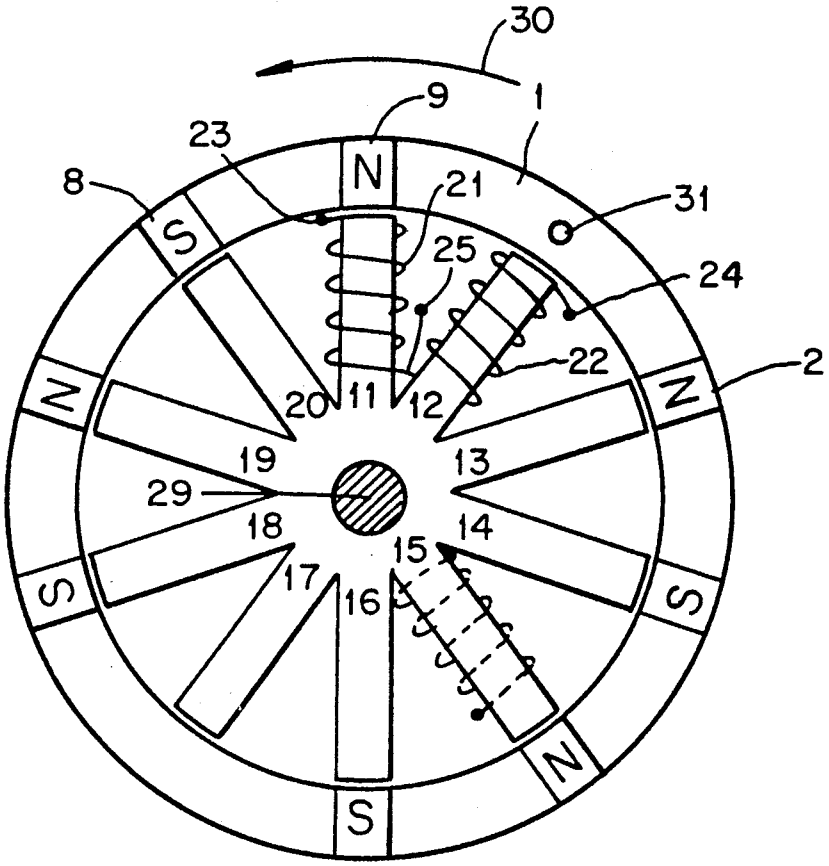
Figure 3I:
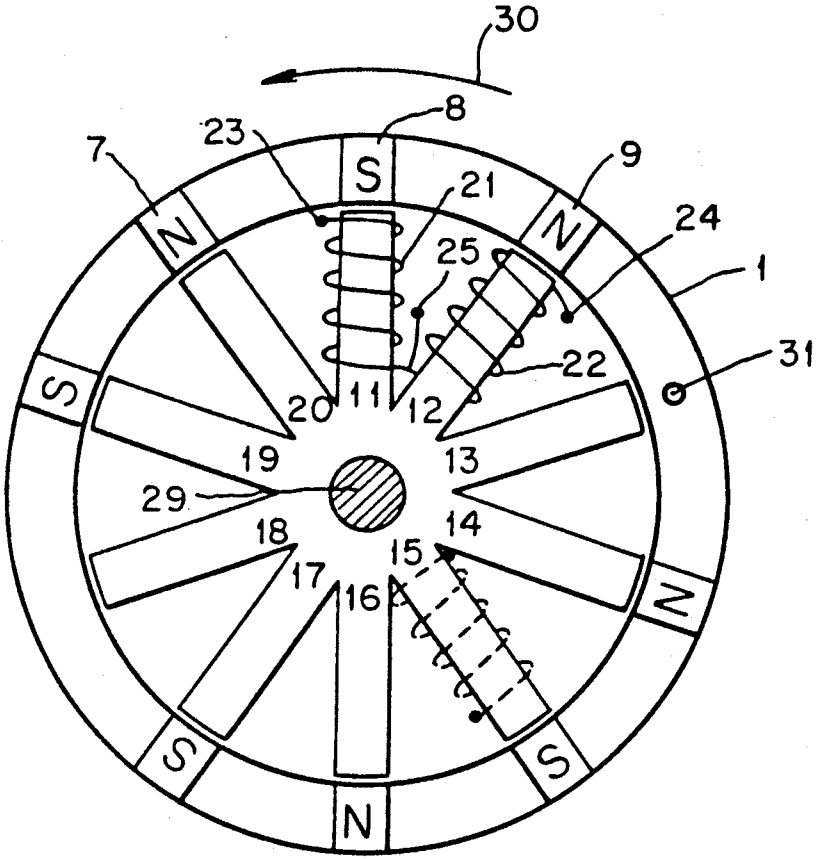

In FIG. 3*a* the flywheel 1 assumes the same position as in FIG. 1. This means, considering the area about windings 21 and 22, that a magnetic flux path is established from pole 2, through leg 12, over to and through leg 13 to the south pole 3. This means in turn that when the said position is reached during rotation in the arrow 30 direction, it is assumed that a positive voltage half-wave is induced in winding 22, so that tapping point 24 shows a positive polarity in relation to tapping point 25. If the magneto flywheel is now rotated one pole pitch in the arrow 30 direction, i.e. so that indication 31 will arrive opposite core leg 20, see FIG. 3*b*, a magnetic flux path is created in the core legs 11 and 12 to the effect that voltages are induced in the related windings 21 and 22. In as much as these windings, as pointed out before, lie in opposition a negative voltage half-wave will arise on tapping points 23 and 24, in consequence with the earlier assumption. If rotation is now continued by one further pole pitch, so that indication 31 lands opposite core leg 19, see FIG. 3*c*, also here a flux path arises, through legs 11 and 12, to the effect that a positive polarity is now appearing on the two tapping points 23 and 24. Here the windings oppose one another as in the earlier case. If the flywheel 1 is rotated a further pole pitch, see FIG. 3*d*, i.e. so that indication 31 will lie opposite core leg 18, magnet poles 4 and 5 thus lying opposite legs 11 and 12, also here like voltage polarities appear on the two tapping points 23 and 24. If the flywheel is now rotated one pole pitch further, see FIG. 3*e*, pole 5 will arrive opposite the core leg 11, which means that a flux path including pole 4 will be created through legs 11 and 20. This means in turn that a negative voltage half-wave will be induced at tapping point 23 whereas winding 22 becomes dead, as no magnet pole cooperates with leg 12. This rotational position is an important position as will be disclosed in greater detail below.

If the magneto flywheel is rotated one pole pitch further, see FIG. *3f*, indication 31 will land opposite core leg 16, in doing which pole 6 will be located opposite core leg 12 and pole 7 opposite core leg 13. Consequently a magnetic flux will arise in these core legs, said flux inducing a negative voltage at tapping point 24. Rotating now one further pole pitch, see FIG. *3g*, as in previous equivalent cases a flux will arise simultaneously through legs 11 and 12 which means that like voltage polarities appear on tapping points 23 and 24. This pattern will be repeated two pole pitches ahead, as can be seen in FIGS. *3h* and *3i*. When the flywheel has rotated to the position where indication 31 is opposite core leg 12, see FIG. *3j*, magnets 8 and 9 cause induction of a voltage in winding 21 such that a positive polarity appears on tapping point 23. Winding 22 will then be dead, as there is no pole opposite core leg 12. It is to be noted that indication 31 is now at a point which is displaced 180° in relationship to the point previously mentioned, see FIG. *3e* viz., when the indication was opposite core leg 17. In the first mentioned position a positive half-wave was generated in winding 21, whereas a negative half-wave is created in the position now defined.

The condition now described can be utilized in a simple manner to control the ignition process in two cylinders of an combustion engine having a crank shaft displacement of 180°. It is assumed that when a positive voltage appears on tapping point 23 in relation to tapping point 25, this voltage is fed to the discriminator circuit 36 on its inputs 33 and 35, respectively. However, as stated above, on several occasions a positive voltage wave appears on tapping point 23. But it is necessary to sort out those voltage inductions of this polarity which occur during the revolution from that voltage induction which is to form the control pulse for an ignition triggering operation. It is to be noted that when magnet poles coact with the two core legs 11 and 12 the same voltage polarities appear on tapping points 23 and 24. Thus circuit 36 has to be such that when tapping point 24 exhibits the same voltage as point 23 the circuit 36 will not react. If, however, there is no voltage on tapping point 24 the voltage induced in 21 has to be utilized by the circuit. On the other hand, if the circuit is such that when a positive induction appears on tapping point 23, i.e. as in the position latest described, the pulse is conducted to output 37 in order to initiate the ignition circuit 39 to ignite its sparkplug 41. When, however, the situation according to FIG. *3j* occurs, a negative voltage appears on on tapping point 23 whereas tapping point 24 is dead. A negative pulse at input 33 means to the discriminator circuit 36 that a control pulse emerges on line 38, to the effect that the second cylinder ignition circuit 40 comes into action and a spark is tripped on its sparkplug 42.

As shown, the arrangement disclosed makes it possible to attain a highly precise distribution of the ignition processes of two different cylinders. Of course more cylinders than two can be supplied in the manner under consideration with pulses for controlling ignition processes, and the arrangement is useful to two-stroke as well as four-stroke engines. The essential point is that the number of core pitches or divisions has to be even, but half this number has always to be an odd number. Thus in the present case it is the question of ten core pitches, the half thus being five, i.e. an odd number, as stated. If the number of pitches is fourteen, half the number will be seven, and if the number of pitches is eighteen half the number will be nine etc.

Within the scope of the invention such embodiments may of course be conceived wherein a plurality of gaps occur between the poles, that is, symmetrically not merely between poles 2 and 9 and 5 and 6 but also between other poles in structures having several, i.e. closely pitched core legs. The discriminator circuit 36 could, for example, be a micro computor, should such a solution be found appropriate.

I claim:

1. An arrangement in flywheel magnetos, in particular for multiple cylinder combustion engines, wherein a magneto flywheel cooperates with a multi-pitched magnet core carrying windings, characterized in that the number of core pitches (11–20) forms an integer, and half of said number forms an odd number, and the magnet poles, having alternating polarity, are arranged in groups such that the pole pitching within the groups coincides with said core pitching, and such that adjacent core portions, one pitch apart, carry upon each, a control winding connected to a circuit for sensing voltage polarity sequence, to create distributed trigger signals for each respective engine cylinder.

2. An arrangement according to claim 1, characterized in that said magnet pole groups (2, 3, 4, 5–6, 7, 8, 9) on the flywheel (1) are spaced apart by two-core pitches.

3. An arrangement according to claim 1, characterized in that the tapping points (23, 24 25) of said control windings (21, 22) are connected to a micro computer such that the polarity of the voltage momentarily induced in one (21) of the windings will control the distribution of trigger signals to the ignition circuit (39, 40) of the respective cylinder, whereas voltages induced in the other winding (22) form, during the time operational voltages are generated in said last mentioned winding, voltages inhibiting transmission of distributed trigger signals.

4. An arrangement according to claim 1, characterized in that one pair of said control windings are provided for each pair of associated combustion engine cylinders.

5. An arrangement according to claim 1, characterized in that core pitches (31–20) which are not used for control windings carry generator windings (26) which are one of series connected, or series connected sectionwise, in order to produce a bias voltage to associated electronic circuits, as well as to capacitors included in the ignition circuits (39, 40) for producing igniting current.

* * * * *